US010456898B2

(12) United States Patent
Pettersson

(10) Patent No.: US 10,456,898 B2
(45) Date of Patent: Oct. 29, 2019

(54) DAMPING DEVICE FOR A PERCUSSION DEVICE, PERCUSSION DEVICE AND ROCK DRILLING MACHINE

(71) Applicant: Atlas Copco Rock Drills AB, Orebro (SE)

(72) Inventor: Maria Pettersson, Stora Mellosa (SE)

(73) Assignee: Epiroc Rock Drills Aktiebolag, Orebro (SE)

( * ) Notice: Subject to any disclaimer, the term of this patent is extended or adjusted under 35 U.S.C. 154(b) by 343 days.

(21) Appl. No.: 15/103,968

(22) PCT Filed: Jan. 16, 2015

(86) PCT No.: PCT/SE2015/050035
§ 371 (c)(1),
(2) Date: Jun. 13, 2016

(87) PCT Pub. No.: WO2015/122824
PCT Pub. Date: Aug. 20, 2015

(65) Prior Publication Data

US 2016/0318167 A1 Nov. 3, 2016

(30) Foreign Application Priority Data

Feb. 14, 2014 (SE) ..... 1450172

(51) Int. Cl.
*E21B 1/24* (2006.01)
*B25D 17/24* (2006.01)
(Continued)

(52) U.S. Cl.
CPC ..... *B25D 17/245* (2013.01); *B25D 9/12* (2013.01); *E21B 1/02* (2013.01); *E21B 7/025* (2013.01)

(58) Field of Classification Search
CPC .... B65D 17/24; B65D 9/26; B65D 2250/035; B65D 2250/185; B25D 17/24; B25D 9/26; B25D 2250/035; B25D 2250/185
(Continued)

(56) References Cited

U.S. PATENT DOCUMENTS 3,179,185 A * 4/1965 O'Farrell ..... B25D 17/24 173/133
4,073,350 A * 2/1978 Eklof ..... B25D 9/12 173/212
(Continued)

FOREIGN PATENT DOCUMENTS

CN 101098772 1/2008
CN 101189078 5/2008
(Continued)

*Primary Examiner* — Andrew M Tecco
*Assistant Examiner* — Eyamindae C Jallow
(74) *Attorney, Agent, or Firm* — Mark P. Stone

(57) ABSTRACT

Damping device for a percussion device of a hydraulic rock drilling machine (1) with a striking direction (R), including a damping piston (5) for action in an axial direction against a tool, wherein the damping piston (5) exhibits a first piston portion (6), which is received in a first damping chamber (7) and a second piston portion (8), which is received in a second damping chamber (9). In operation, in a normal striking position of said percussion device, the damping piston (5) is set against a fixed stop (19) against movements in the striking direction. A damping slot (10) is established between the first (7) and the second (9) damping chamber in all axial positions of the damping pistons, and the first damping chamber (7) is pressurized with a hydraulic pressure. The invention also concerns a percussion device and a rock drilling machine.

20 Claims, 4 Drawing Sheets

(51) Int. Cl.
*E21B 1/02* (2006.01)
*B25D 9/12* (2006.01)
*E21B 7/02* (2006.01)

(58) Field of Classification Search
USPC ..... 173/162.1, 210; 92/85 R
See application file for complete search history.

(56) References Cited

U.S. PATENT DOCUMENTS

| | | | | | |
|---|---|---|---|---|---|
| 4,109,734 | A | | 8/1978 | Montabert | |
| 4,479,551 | A | * | 10/1984 | Justus | B25D 9/12 173/112 |
| 4,624,325 | A | * | 11/1986 | Steiner | F16F 9/516 173/133 |
| 4,871,035 | A | * | 10/1989 | Ekwall | B25D 17/245 173/212 |
| 5,002,136 | A | | 3/1991 | Barthomeuf | |
| 5,056,606 | A | | 10/1991 | Barthomeuf | |
| 5,479,996 | A | * | 1/1996 | Jonsson | B25D 9/265 173/2 |
| 5,896,937 | A | * | 4/1999 | Kaneko | B25D 9/145 173/105 |
| 6,186,246 | B1 | * | 2/2001 | Muuttonen | B25D 9/145 173/1 |
| 6,318,478 | B1 | * | 11/2001 | Kaneko | B25D 17/24 173/135 |
| 6,854,538 | B2 | | 2/2005 | Muuttonen | |
| 7,032,684 | B2 | * | 4/2006 | Muuttonen | E21B 7/022 173/11 |
| 7,419,015 | B2 | * | 9/2008 | Muuttonen | B25D 9/18 175/296 |
| 7,958,947 | B2 | * | 6/2011 | Larsson | B25D 17/24 173/200 |
| 8,365,840 | B2 | * | 2/2013 | Sinnerstad | E21B 44/08 175/24 |
| 8,733,467 | B2 | * | 5/2014 | Kandelin | B25D 9/14 173/104 |
| 2009/0194336 | A1 | * | 8/2009 | Larsson | B25D 17/24 175/296 |
| 2011/0220421 | A1 | * | 9/2011 | Muuttonen | B25D 9/14 175/293 |
| 2011/0240322 | A1 | * | 10/2011 | Kandelin | B25D 9/14 173/104 |

FOREIGN PATENT DOCUMENTS

| | | |
|---|---|---|
| CN | 101346527 | 1/2009 |
| DE | 4104917 | 8/1992 |
| EP | 0080446 | 6/1983 |
| EP | 0112810 | 7/1984 |
| EP | 1160416 | 12/2001 |
| FR | 2596681 | 10/1987 |
| FR | 2647870 | 12/1990 |
| JP | H 01205984 | 8/1989 |
| JP | H 1133932 | 2/1999 |
| KR | 20050008565 | 1/2005 |
| SE | 458672 | 4/1989 |
| SE | 463193 | 8/1990 |
| WO | WO 2010/082871 | 7/2010 |

* cited by examiner

DAMPING DEVICE FOR A PERCUSSION DEVICE, PERCUSSION DEVICE AND ROCK DRILLING MACHINE

FIELD OF THE INVENTION

The invention concerns a damping device for a percussion device of a hydraulic rock drilling machine with a striking direction, including a damping piston for action in an axial direction against a tool to be driven by the percussion device, wherein the damping piston exhibits a first piston portion, which is received in a first damping chamber and at least a second piston portion, which is received in a second damping chamber. The invention also concerns a percussion device and a rock drilling machine.

BACKGROUND OF THE INVENTION

The purpose of a damping device in a percussion device in a rock drilling machine is to protect the machine from reflected shock waves occurring during drilling. The damping device also has the purpose of providing better conditions for transferring the feed force from a rock drill rig over the drill steel to the rock by ensuring rock contact during drilling.

A previously known so called floating damping device for percussive devices includes a first chamber which is connected to an accumulator and a second chamber in order to cushion reflexes emanating from the drill steel. A damping piston snuggly fits into the second chamber which results in that reflexes from the rock are cushioned in that liquid is pressed out through the slot formed between the piston and the machine housing when the piston moves in a direction opposite to the striking direction.

For the purpose of obtaining a so called floating position, around which it can be moved in the striking direction as well as opposite thereto, and in which the damping piston is intended to be positioned prior to a strike, the damper is supplied with a constant damper liquid flow.

It is aim of the present invention to provide a further development of previously known damping devices which generally seen addresses certain problems of the existing technology.

MOST IMPORTANT FEATURES OF THE INVENTION

This aim is obtained in respect of an invention as indicated initially in that in operation, in a normal striking position for said percussion device, the damping piston is set against a fixed stop against movements in the striking direction, that a damping slot is established between the first and the second damping chamber in all axial positions of the damping pistons, and that the first damping chamber is pressurized with a hydraulic pressure.

Hereby on the one hand is achieved an energy absorbing function, on the other hand reduced energy consumption since it is no longer required to have a fluid supply or a flow of damper liquid to the damping device in order to reach a floating position.

Since the movements of the damping piston will be more limited according to the invention compared to a corresponding damping device of the previously known kind, no specially provided accumulator will be necessary for supply to the damping device which results in further reduced costs.

Compared to a conventional, so called single damper, which in principle works as a spring, an effective energy reception will be obtained through the invention and thereby effective damping of reflected shock waves. Better conditions for rock contact during as great a part as possible of the drilling cycle can thereby be expected as well as enhanced tightening of drill string joints and thereby better drilling economy.

Since the invention provides a simplified construction over comparable damping devices, the result will be a more economic solution.

When a strike by the percussion device has driven forward the shank adapter or a corresponding component, the drilling machine will be driven forward by the feed system which can be required to be set for a higher feed force, or corresponding, relative to a previously known floating double damper because of the expected reduced axial movements of the damping piston.

Upon the occurrence of a subsequent rock reflex, therefore the damping piston will be driven rearwards some distance, whereby a liquid volume being displaced from the damping chambers will be driven through the damping slot and be heated therein, whereby the reflected energy will be absorbed. Repositioning of the damping piston against the fixed stop is thereupon taken care of by the pressure in the first damping chamber, through the permanent pressurization of this chamber.

It is preferred that the damping piston acts against a shank adapter through any one from the group being comprised of: directly, over a drill bushing, over a portion of a rotation housing.

Suitably the first damping chamber is connected to a source for percussion device pressure, which is advantageous since thereby a pressure that is already available in the machine and is of a suitable magnitude can be used.

It is preferred that the first damping chamber there is connected a pressure fluid channel, which includes a throttle in the region of its mouth in the first chamber. By the throttle being adjustable or dimensioned for adaption of the speed of the damping piston during damping movements, the cushioning can be adapted to different expected operational conditions etc.

It is preferred that a ratio volume/cross sectional area of the first damping chamber exceeds a ratio volume/cross sectional area of the second damping chamber. Hereby the second chamber will become a more rigid chamber, from where the essential fluid displacement will occur which finds its way through adjacent damping slot (slots) for energy take-up.

Leaking slots adjoin preferably to each axial end of a damping chamber facing in direction from an adjacent damping chamber.

Preferably each leaking slot communicates with a channel being connected to drainage or return flow.

It is within the scope of the invention that the first and/or the second damping chamber has damping slot connection to at least one further damping chamber, wherein is received a corresponding piston portion arranged on the damping piston.

The second damping chamber is preferably advantageously closed except for said damping slot emanating from a first axial end and a leaking slot emanating from a second axial end.

It is preferred that the damping piston on its end facing the striking direction exhibits an abutment portion for co-operation with a fixed stop in a housing of the rock drilling machine in the form of an axially directed abutment surface.

The invention also relates to a percussion device with a damping device according to the above for damping rock reflexes.

The invention also relates to a rock drilling machine including such a percussive device. Such a rock drilling machine can with different suitable embodiments include a drill bushing and/or a portion of a rotation housing between the damping piston and the tool.

Advantages as above relating to the damping device are correspondingly obtained in a percussion device and a rock drilling machine according the invention.

Further features and advantages of the invention will be explained in the following detailed description with reference to the annexed drawings.

BRIEF DESCRIPTION OF DRAWINGS

The invention will now be described in more detail by way of embodiments with reference to the drawings, wherein.

DESCRIPTION OF EMBODIMENTS

Figure 1:
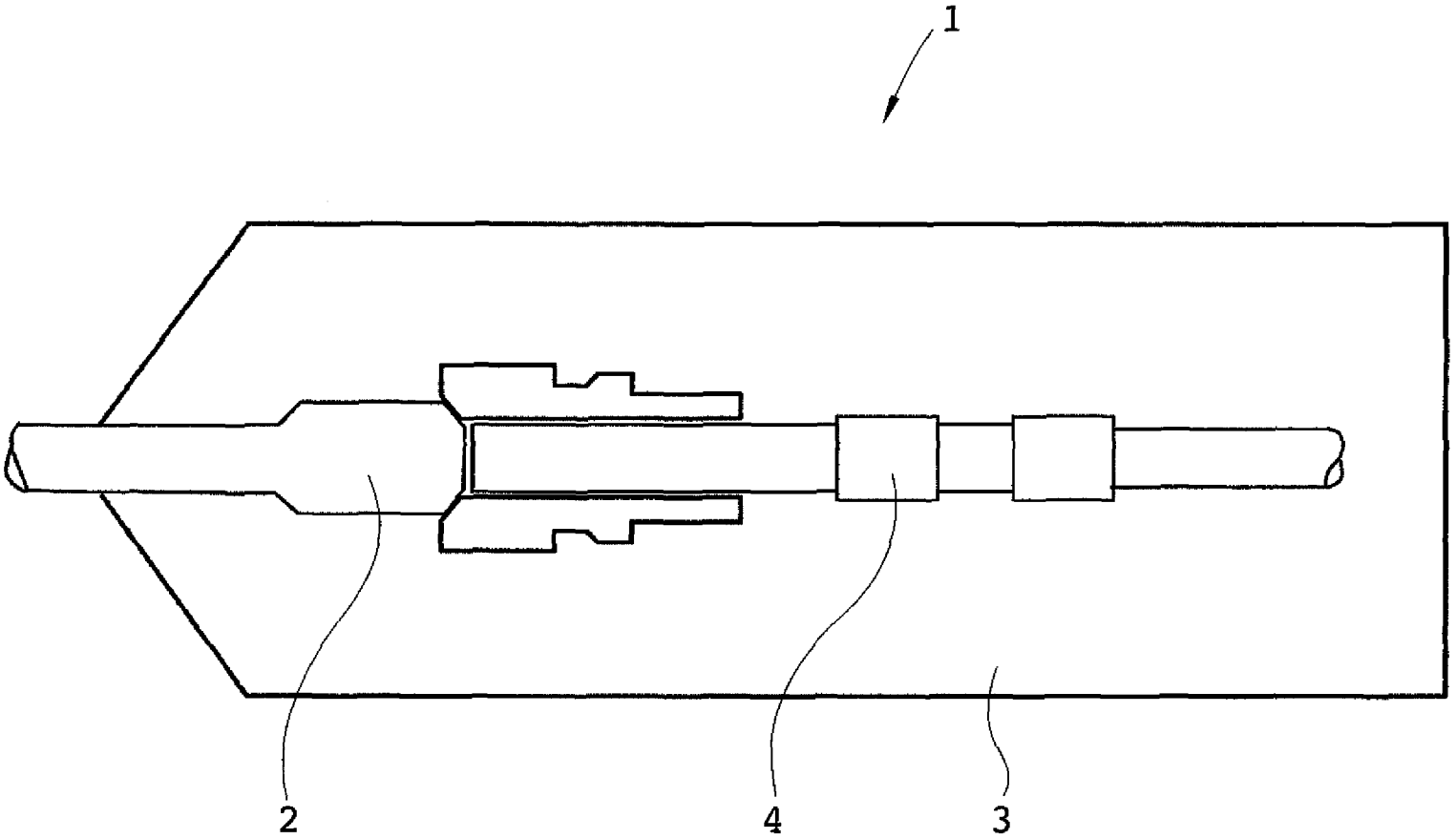
FIG. 1 diagrammatically shows a rock drilling machine.

A rock drilling machine according to the invention is shown diagrammatically in FIG. 1, wherein the rock drilling machine 1 inside a housing 3 includes a damping device for cushioning rock reflexes occurring after that a percussive piston 4 has performed a strike against a shank adapter 2.

Figure 2:
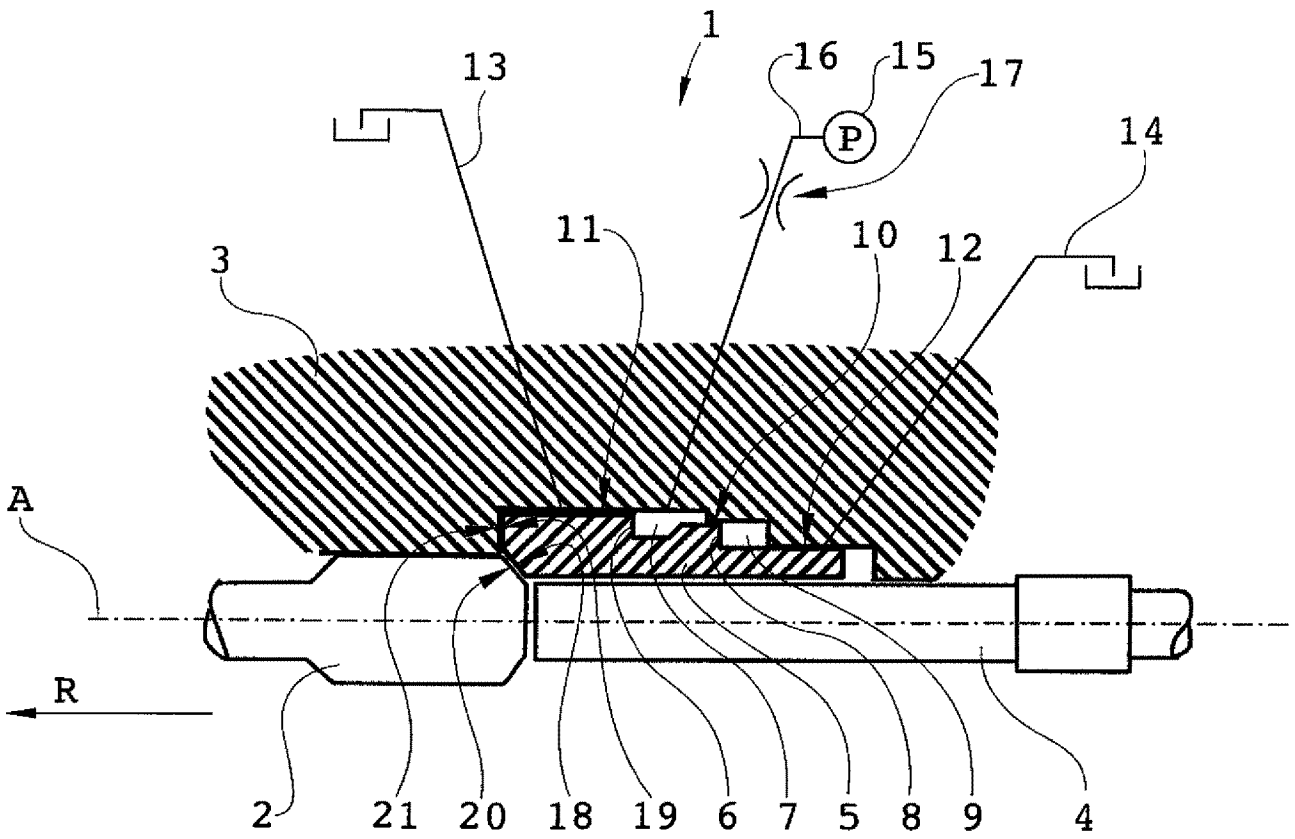
FIG. 2 shows a damping device according to the invention in a first embodiment.

The damping device, which is shown in a greater detail in FIG. 2, includes a damping piston 5 which is disposed concentrically around the percussive piston 4 and which on the one hand lies with an abutment surface 20 against a corresponding contact surface 18 on the shank adapter 2, on the other hand with the aid of an abutment portion 21 is lying against a fixed stop 19 in the form of an axially directed surface in the machine housing 3. This fixed stop 19 provides a defined position for the damping piston 5 in normal operation of the percussive device of the rock drilling machine when the percussive piston 4 performs a strike against the shank adapter 2 in a striking direction R.

Figure 3:
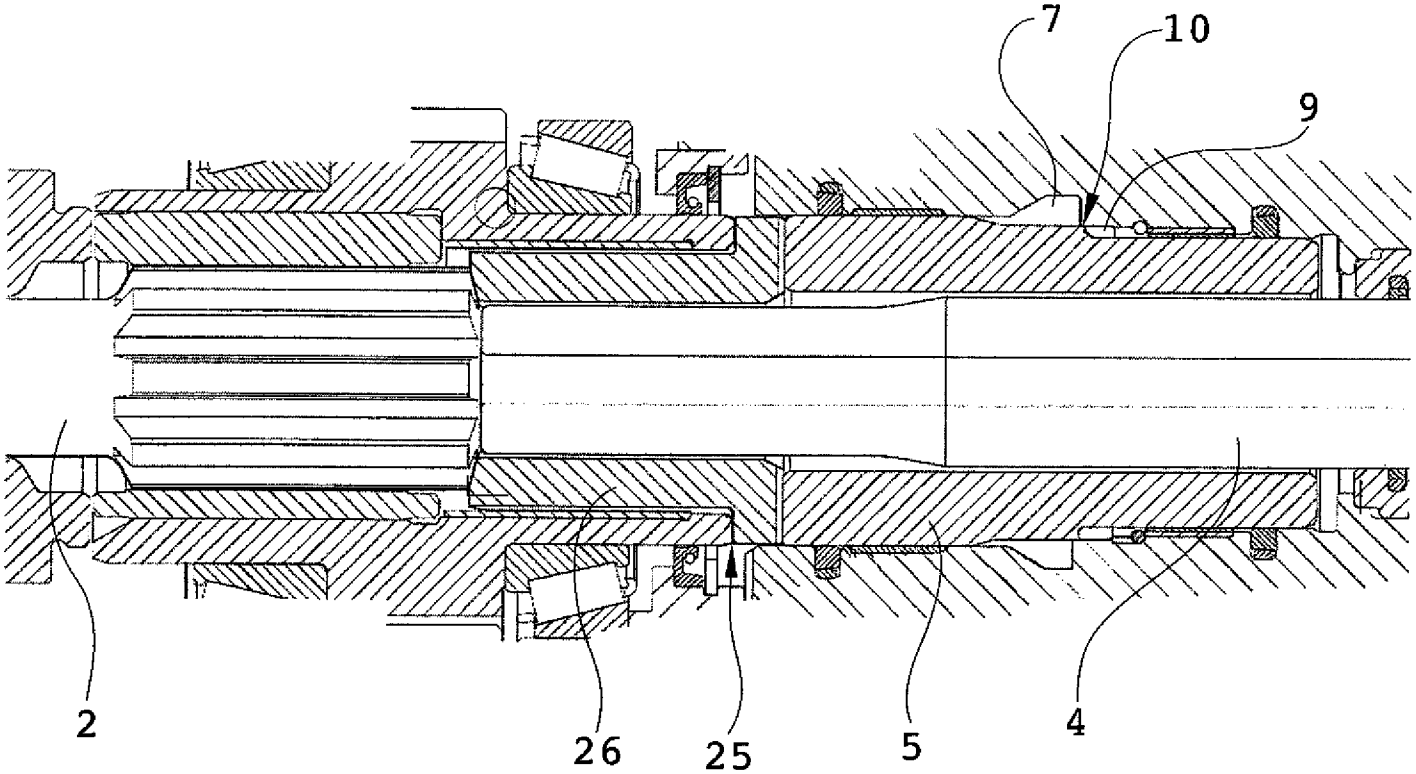
FIG. 3 shows a damping device according to the invention in a second embodiment.
Figure 4:
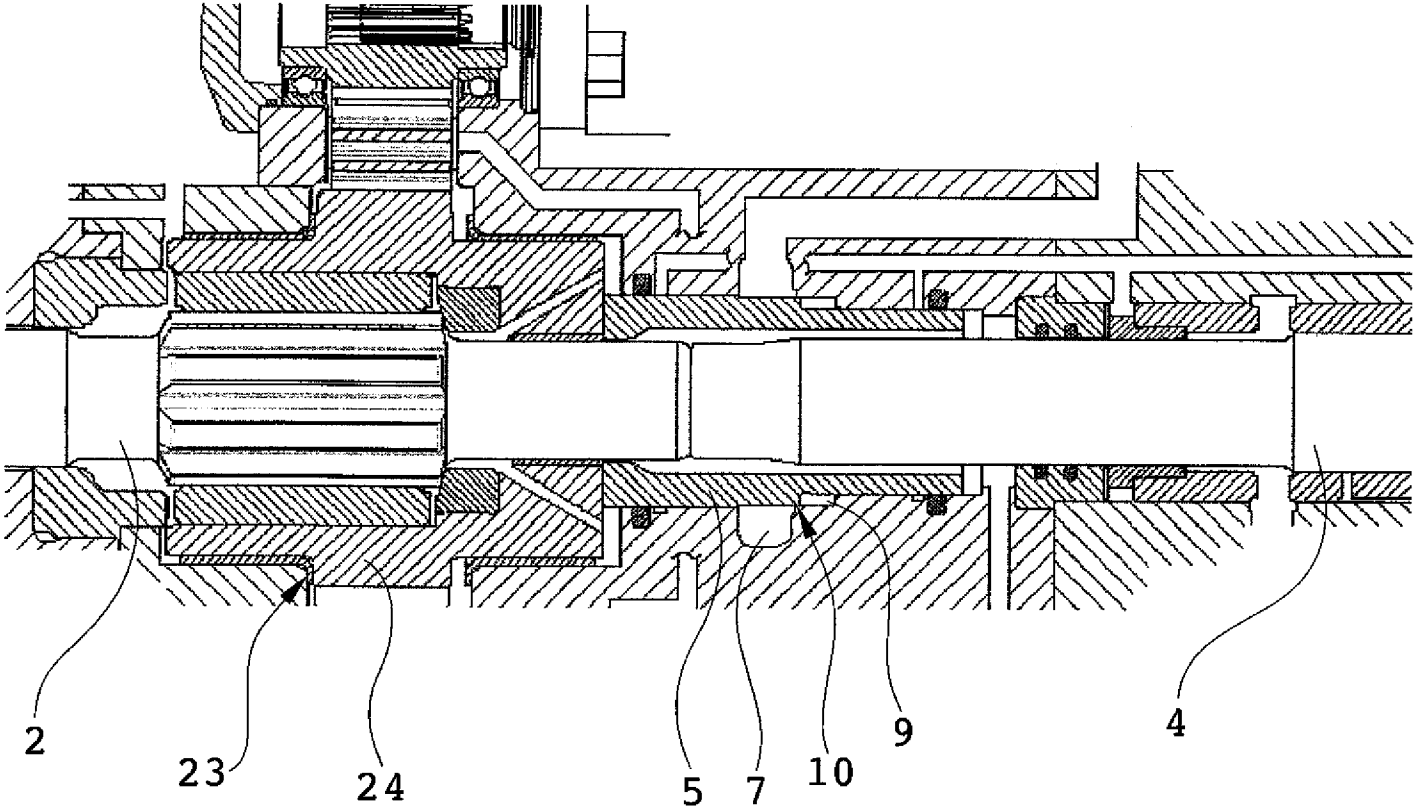
FIG. 4 shows a damping device according to the invention in a third embodiment.

The damping piston 5 exhibits a first piston portion 6, which is received in a first damping chamber 7 and a second piston portion 8, which is received in a second damping chamber 9. The first and the second damping chambers are ring-shaped chambers which are concentric around a symmetry axis A which is common to the percussive piston 4 and the damping piston 5. As illustrated by FIGS. 2-4, the damping chambers 7 and 9 are adjacent to each other.

Between the first and the second damping chambers 7 and 9, in all possible axial positions of the damping piston 5, there is established a damping slot 10, which provides a certain leak communication between the damping chambers and which adjoins to a first axial end of the second damping chamber 9. As illustrated by FIGS. 2-4, the damping slot 10 is arranged to provide direct fluid communication between the adjacent damping chambers 7 and 9. Furthermore, adjoining to a front axial end of the first damping chamber, opposite to the rear axial end, where the damping slot 10 emanates, there is established a leaking slot 11 against the housing 3, said leaking slot communicates with a draining channel 13. The draining channel 13 leads to a collecting tank or with a return conduit to lead through-flowing hydraulic medium for reuse in the percussion device.

To a second axial end of the second damping chamber 9 opposite to the first axial end, where the damping slot 10 emanates, there is emanating a leaking slot 12, which in turn communicates with a draining channel 14, which leads to a collecting tank. Also in this case the draining channel 14 can be a return channel according to the above.

Furthermore, to the first damping chamber 7 is joining a pressure fluid channel 16 which provides essentially constant pressurizing of this first damping chamber 7 through connection to a pressure source 15, which is preferably a source for pressure fluid under the pressure of the percussion device.

In the region of the connection of the pressure fluid channel 16 to the first damping chamber 7, the pressure fluid channel 16 is provided with a throttle 17, which is adapted or adjustable for adjusting the return movement of the damping piston 5 when the damping piston 5 receives a strike reflection from the shank adapter 2.

During operation of the percussion device according to the invention, the damping piston 5 is set, through the providing pressure in the first and in the second damping chambers, on the one hand against said fixed stop, on the other hand against the contact surface on the shank adapter. Upon receiving a rock reflex, the shank adapter 2 will move axially opposite to the striking direction R and thereby drive the damping piston 5 somewhat in the same direction, which is opposite to the striking direction R. As a consequence thereof, liquid contained in the second damping chamber 9 will basically be pressed through the damping slot 10 for energy reception.

In general it can be said that the damping slot 10 is dimensioned such that the flow therethrough is adapted for obtaining an adapted, desired damping. In addition, the leaking slots 11 and 12 are dimensioned for obtaining an adapted desired cooling of the damping device in operation.

Because of the geometry of the first and of the second damping chambers, wherein a ratio volume/cross sectional area of the first damping chamber 7 exceeds a ratio volume/cross sectional area of the second damping chamber 9, the second damping chamber 9 will be experienced as a more rigid, less elastic chamber whereas the first damping chamber will be experienced as a more elastic and more flexible damping chamber, wherein a certain return flow exists into the pressure fluid channel 16 over the throttle 17.

Also from the first damping chamber 7, however, a certain liquid volume will be displaced through the leaking slot 11 such that energy take-up and movement cushioning will occur. Through the damping slot 10, according to the above, as a consequence of a rock reflex, liquid displacement will occur in general from the second damping chamber 9, whereby energy reception and damping will occur.

In FIG. 3 is shown an alternative embodiment, wherein the damping piston 5 lies against the shank adapter 2 over a drill bushing 26, which also has means for lying in abutment co-operation with a fixed stop shown at 25. The general solution is otherwise the same. Like and similar elements have been given the same reference signs as in FIG. 2.

In FIG. 4 is shown a third embodiment of the invention, wherein the damping piston 5 only lies against a rotation housing 24, which surrounds the upper portion of the shank adapter 2. In this case the rotation housing 24 lies against an axially fixed stop 23 acting between the rotation housing 24 and the housing 3, in this case being the fixed stop against which the damping piston 5 is set to counteract movements of in the striking direction.

The invention can be modified within the scope of the following claims. Transfer of shock wave reflexes to the damping piston can also be arranged differently.

The liquids used in connection with the invention are the usual hydraulic fluids for similar applications.

The invention claimed is:

1. Damping device for a percussion device of a hydraulic rock drilling machine (1) with a striking direction (R), including a damping piston (5) for action in an axial direction against a tool to be driven by the percussion device, wherein the damping piston (5) exhibits a first piston portion (6), which is received in a first damping chamber (7) and a second piston portion (8), which is received in a second damping chamber (9), said first and second damping chambers being defined adjacent to each other, wherein:

in operation, in a normal striking position for said percussion device, the damping piston (5) is set against a fixed stop (19, 22) against movements in the striking direction, a damping slot (10) is established between the first (7) and the second (9) damping chamber in all axial positions of the damping piston, said damping slot arranged to provide direct fluid communication between the adjacent first and second damping chambers, and the first damping chamber (7) is pressurized with a hydraulic pressure.

2. Damping device according to claim 1, wherein the damping piston (5) acts against a shank adapter (2) directly, or over a drill bushing, or over a portion of a rotation housing.

3. Damping device according to claim 2, wherein the first damping chamber (7) is connected to a source (15) for percussion device pressure.

4. Damping device according to claim 2, wherein a pressure fluid channel (16) is connected to the first damping chamber (7) said pressure fluid channel (16) including a throttle (17) in the region of its mouth in the first damping chamber (7).

5. Damping device according to claim 2, wherein the ratio of the volume/cross sectional area of the first damping chamber (7) exceeds the ratio of the volume/cross sectional area of the second damping chamber (9).

6. Damping device according to claim 2, wherein a leaking slot (11, 12) is provided at opposed axial ends of each of said first and second damping chambers (7,9), respectively.

7. Damping device according to claim 2, wherein the damping piston (5) on its end facing the striking direction exhibits an abutment portion (21) for co-operation with a fixed stop in a housing (3) of the rock drilling machine (1) in the form of an axially directed abutment surface (19).

8. Damping device according to claim 1, wherein the first damping chamber (7) is connected to a source (15) for percussion device pressure.

9. Damping device according to claim 1, wherein a pressure fluid channel (16) is connected to the first damping chamber (7), said pressure fluid channel including a throttle (17) in the region of its mouth in the first damping chamber (7).

10. Damping device according to claim 9, wherein the throttle (17) is adjustable or dimensioned for adaption of the speed of the damping piston (5) during damping movements.

11. Damping device according to claim 1, wherein the ratio of the volume/cross sectional area of the first damping chamber (7) exceeds the ratio of the volume/cross sectional area of the second damping chamber (9).

12. Damping device according to claim 1, wherein a leaking slot (11, 12) is provided at opposed axial ends of each of said first and second damping chambers (7,9), respectively.

13. Damping device according to claim 12, wherein each said leaking slot (11, 12) communicates with a channel (13, 14) connected to drainage or return flow.

14. Damping device according to claim 13, wherein the second damping chamber (9) is closed except for said damping slot (10) emanating from a first axial end and a leaking slot (12) emanating from a second axial end.

15. Damping device according to claim 12, wherein the second damping chamber (9) is closed except for said damping slot (10) emanating from a first axial end and a leaking slot (12) emanating from a second axial end.

16. Damping device according to claim 1, wherein the damping piston (5) on its end facing the striking direction exhibits an abutment portion (21) for co-operation with a fixed stop in a housing (3) of the rock drilling machine (1) in the form of an axially directed abutment surface (19).

17. Percussion device with a damping device for damping rock reflexes, wherein said percussion device includes a damping device according to claim 1.

18. Rock drilling machine, wherein said rock drilling machine includes a percussion device according to claim 17.

19. Rock drilling machine according to claim 18, wherein said rock drilling machine includes a drill bushing (3), or a portion of a rotation housing between the damping piston (8) and the tool, or both.

20. Damping device for a percussion device of a hydraulic rock drilling machine (1) with a striking direction (R), including a damping piston (5) for action in an axial direction against a tool to be driven by the percussion device, wherein the damping piston (5) exhibits a first piston portion (6), which is received in a first damping chamber (7) and a second piston portion (8), which is received in a second damping chamber (9), wherein:

in operation, in a normal striking position for said percussion device, the damping piston (5) is set against a fixed stop (19, 22) against movements in the striking direction, a damping slot (10) is established between the first (7) and the second (9) damping chamber in all axial positions of the damping piston, and the first damping chamber (7) is pressurized with a hydraulic pressure, wherein a leaking slot (11, 12) is provided at opposed axial ends of each of said first and second damping chambers (7,9), respectively, wherein each said leaking slot (11, 12) communicates with a channel (13, 14) connected to drainage or return flow, and wherein the first damping chamber (7), or the second damping chamber (7, 9), or both, has a damping slot connection to at least one further damping chamber, wherein a corresponding piston portion arranged on the damping piston is received in said at least one further damping chamber.

* * * * *